United States Patent [19]

Kostos et al.

[11] Patent Number: 5,024,023

[45] **Date of Patent: * Jun. 18, 1991**

[54] INSULATED REFRIGERATOR DOOR ASSEMBLY WITH SUBSTANTIALLY ALL GLASS FRONT DOORS

[75] Inventors: Jeffery Kostos; Melvin Kaspar, both of La Grange Park; Paul Artwohl, Flossmoor, all of Ill.

[73] Assignee: Ardco, Inc., Chicago, Ill.

[ * ] Notice: The portion of the term of this patent subsequent to Mar. 12, 2008 has been disclaimed.

[21] Appl. No.: 602,791

[22] Filed: Oct. 24, 1990

Related U.S. Application Data

[62] Division of Ser. No. 448,328, Dec. 11, 1989, Pat. No. 4,998,382.

[51] Int. Cl.[5] ..... E06B 3/00

[52] U.S. Cl. ..... 49/501; 49/DIG. 1; 49/504; 52/790

[58] Field of Search ..... 49/501, 504, DIG. 1, 49/400–402; 52/397, 398, 789, 790, 788, 821, 208; 156/100

[56] References Cited

U.S. PATENT DOCUMENTS

| | | | |
|---|---|---|---|
| 1,805,969 | 5/1931 | Boström | 156/100 X |
| 2,205,522 | 6/1940 | Fix | 52/398 X |
| 2,834,999 | 5/1958 | Taylor et al. | 52/398 X |
| 3,499,245 | 3/1970 | Winsler et al. | 49/504 X |
| 3,971,178 | 7/1976 | Mazzoni et al. | 52/790 X |
| 3,975,881 | 8/1976 | Ninowski, Jr. | 49/DIG. 1 |
| 4,138,284 | 2/1979 | Postupack | 156/100 |
| 4,514,948 | 5/1985 | Meigs et al. | 52/397 |
| 4,604,840 | 8/1986 | Morison | 52/788 X |
| 4,637,167 | 1/1987 | Svensson | 49/501 X |
| 4,719,728 | 1/1988 | Eriksson et al. | 52/790 X |
| 4,741,127 | 5/1988 | Bockwinker | 49/501 |
| 4,817,335 | 4/1989 | Adell | 49/462 |
| 4,825,609 | 5/1989 | Rundo | 52/397 X |
| 4,831,780 | 5/1989 | Bockwinkel | 49/DIG. 1 |
| 4,852,303 | 8/1989 | Rolek | 49/478 X |
| 4,873,803 | 10/1989 | Rundo | 56/397 X |
| 4,948,206 | 8/1990 | Fitzpatrick | 49/402 X |

*Primary Examiner*—Rodney M. Lindsey
*Assistant Examiner*—Jerry Redman
*Attorney, Agent, or Firm*—Leydig, Voit & Mayer

[57] ABSTRACT

A multi-pane insulated glass door assembly in which the forward pane of the glass unit extends outwardly a greater distance than the panes rearwardly thereof and is supported by an outer metal frame having a relatively narrow forwardly extending perimeter portion adjacent the peripheral edge of the forward glass pane so as to provide the door with a modernistic, substantially all glass front appearance. In the illustrated embodiment, the outer metal frame has a rear portion extending inwardly behind the forward glass pane and a moulding is interposed between the forwardly extending perimeter portion of the metal frame and the peripheral edge of the forward glass pane to provide a finished appearance. A dark ink is affixed to an inside peripheral face of the forward glass pane for masking the peripheral components of the door assembly from sight through the forward glass pane from the front side thereof.

13 Claims, 2 Drawing Sheets

INSULATED REFRIGERATOR DOOR ASSEMBLY WITH SUBSTANTIALLY ALL GLASS FRONT DOORS

DESCRIPTION OF THE INVENTION

The present application is a continuation of U.S. Pat. No. 4,998,382 filed Dec. 11, 1989.

The present invention relates generally to insulated glass doors, and more particularly, to multi-pane insulated glass door assemblies such as used in commercial refrigeration and freezer units.

For over thirty years, insulated glass door assemblies for commercial refrigerator and freezer insulations have comprised an insulated glass unit made up of two or more glass panes maintained in spaced-apart relation by tubular spacers with the interior between the panes appropriately sealed. The glass unit in turn is supported within a relatively rugged outer metallic frame, commonly formed from aluminum extrusions, with the metal frame overlapping the periphery of the glass unit for retaining the glass unit in position and for providing a decorative finished appearance to the door assembly. While improvements in energy efficiencies, structural rigidity, and mounting of such door assemblies have taken place over the years, such insulated glass door assemblies have remained substantially unchanged in their outer appearance. Although the desire for style changes has existed, cost considerations usually have prevented product changes.

Because of increasing customer demand for styling changes, manufacturers recently have introduced more modernistic appearing glass door assemblies. These doors have included a single, relatively thick pane which provides the appearance of an all-glass, relatively contemporary, front to the door assembly. While such doors are attractive in appearance, they do not have the efficiency, safety, and durability features the industry has grown to expect in commercial insulated refrigerator door assemblies and have been unable to withstand the relatively abusive use in commercial establishments where doors are repeatedly opened and closed and are frequently struck by shopping carts and the like.

It is an object of the present invention to provide an insulated refrigerator door assembly which has a modernistic, stylized appearance, but which retains the efficiency and structural features to which the industry has grown accustom over the years.

Another object is to provide an insulated glass door assembly as characterized above which has a substantially all-glass contemporary front appearance.

A further object is to provide an insulated glass door assembly of the above kind which has an appearance that is distinct from conventional refrigerator glass door assembly over the years, but which is constructed in substantially similar manner, and hence, lends itself to economical manufacture by existing production techniques.

Other objects and advantages of the invention will become apparent upon reading the following detailed description and upon reference to the drawings, in which.

Figure 1:
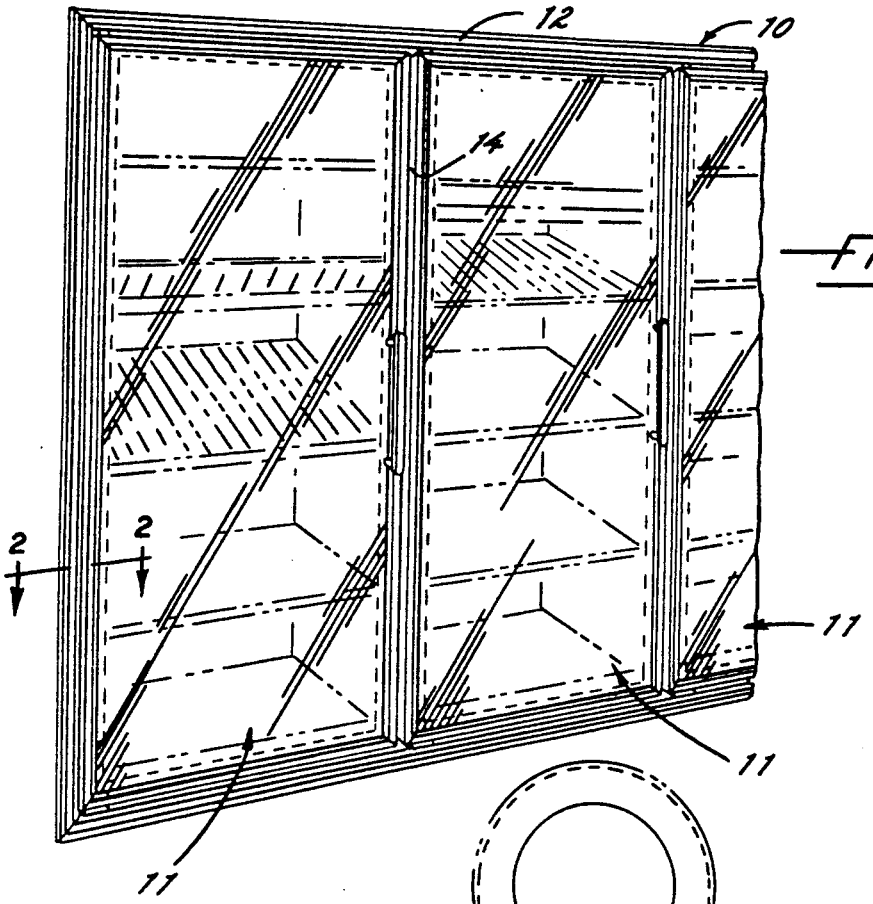
FIG. 1 is a perspective of a refrigerator door assembly having a plurality of insulated glass doors embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Referring now more particularly to the drawings, there is shown an illustrative refrigerator door assembly 10 comprising a plurality of insulated glass doors 11 embodying the present invention each mounted for swinging movement in a door mounting cabinet frame 12, which in turn is mounted within an opening in a front wall 13 of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12, which may be of a conventional construction, extends about the periphery of the opening in the wall 13 and includes a plurality of mullions 14 that extend vertically between the top and bottom perimeters of the frame to provide rigidity for the frame 12 and define sealing surfaces against which the free swinging sides of the doors 11 engage when in a closed condition.

The cabinet frame 12 includes a plurality of frame members 15, preferably in the form of extrusions made of aluminum or other suitable metal material, arranged in a rectangular configuration about the periphery of the cabinet opening. The illustrated frame members 15 have a generally Z-shaped configuration comprising a front flange 16, a rear flange 18, and a web 19 extending therebetween. The front and rear flanges 16, 18 project in opposite directions, generally at right angles to the web 19. The rear flange 18 defines a plurality of channels 20 which are adapted to receive one or more electrical heating cables 21 for the purpose of maintaining the extrusion at a temperature sufficient to avoid a build up of condensation. An appropriate insulating material 23 also may be provided. The rear flange 18 has a removable cover plate 22 which encloses the channels 20 and provides a sealing surface against which the doors close. An insulating strip 24, preferably made of plastic, is interposed between the frame member web 19 and the cabinet wall 13 and in this case also encompasses a rear side of the flange 18. For illuminating the interior of the cabinet, a light fixture 25 may be mounted on the flange 18 in rearwardly extending fashion.

The insulated glass doors 11 each include an insulated glass unit 30 comprising a plurality of glass panes, 31, 32, 33, disposed in parallel side-by-side relation with a spacer 35 interposed between adjacent panes. The illustrated glass unit 30 includes a forward plane 31 disposed on the front or ambient air side of the door, a rear plant 33 disposed on the rear or refrigerated side of the door, and an intermediate pane 32 disposed between the forward and rear panes 31, 33. As is known in the art, each spacer 35 may comprise a plurality of elongated metal tubular members disposed in a rectangular arrangement between the respective adjacent glass panes, and in this case, each spacer is located inwardly a distance from the peripheral edges of the glass panes so as to define outwardly opening channel areas 36 about the perimeter of the glass unit 30. An appropriate sealant preferably is provided between the sides of the spacers 35 and the adjacent glass panes 31, 32, 33 for establishing a primary vapor seal. For supporting the glass unit 30, each door 11 has an outer metal frame 40, preferably assembled from a plurality of extrusions made of aluminum or other suitable metal, which are disposed about the periphery of the glass unit 30 and joined together by suitable corner keys as is known in the art.

In accordance with the invention, the forward pane of each door extends substantially to the outer perimeter of the door for providing a modernistic, substantially all-glass front appearance to the door. To this end, the outer metal frame 40 has a relatively small-sized, forward perimeter portion 41 extending into the plane of the forward glass pane 31 in close outwardly spaced relation to the peripheral edge thereof and a moulding 42 is interposed in slightly overlapping relation between the outer peripheral edge of the forward glass pane 31 and the forward metal frame portion 41 for filling the space therebetween and for providing a relative smooth finished appearance to the front side of the door. The forward metal frame perimeter portion 41 in this instance extends outwardly a relatively small distance beyond the plane of the front face of the forward glass pane 31 and the moulding 42 has a forward, relatively flat head portion with lips 44 overlapping respective peripheral edge portions of the forward glass pane 31 and the forward metal frame portion 41. From a front perspective, the door 11 has a flat substantially all-glass front appearance with the forward glass pane 31 extending outwardly substantially to the outer perimeter of the door, in distinct contrast to conventional commercial refrigerator doors in which the outer metal frame significantly overlaps the front face of the forward glass pane to provide a decorative trim about the door.

Figure 5:
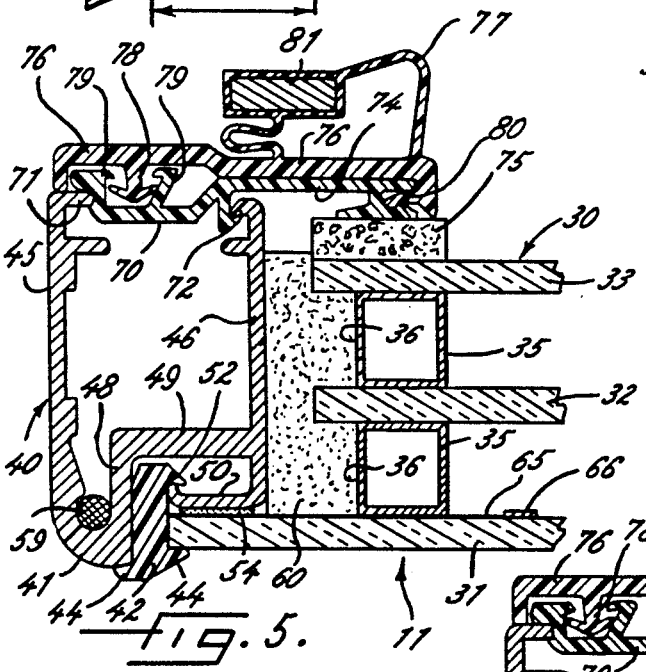
FIG. 5 is an enlarged fragmentary section of one of the doors of the illustrated assembly; and, FIG. 6 is an enlarged fragmentary section, similar to FIG. 5, but showing an alternative embodiment of door construction.

In carrying out the invention, the forward glass pane 31 extends outwardly a distance greater than the intermediate and rear planes 32, 33 and the metal door frame 40 had a rear portion extending inwardly behind the forward glass pane 31 in outwardly spaced relation the outer peripheral edges of the intermediate and rear panes 32, 33. As best shown in FIG. 5, the metal frame 40 in this case has a rearwardly opening channel shape with outer and inner side walls 45, 46 disposed in parallel relation to each other. The outer side wall 45 is located in outwardly spaced relation to the periphery glass unit 30 and forms one side of the forwardly extending frame perimeter portion 41, which in this instance has a general U-shaped configuration, the other side 48 of which is connected to the inner side wall 46 by a transverse wall 49 located rearwardly of the rear face of the forward glass pane 31.

Figure 6:
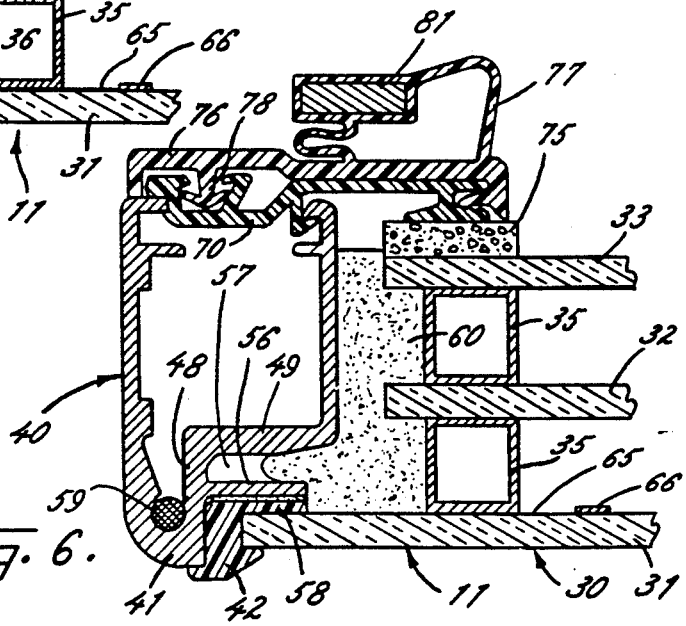

The inner side wall 46 of the metal frame 40 in this instance is formed with an outwardly extending flange 50 in closely adjacent parallel relation so the rear face of the forward glass pane 31 and extends to the peripheral edge of the forward glass pane 31. The terminal end of the flange 50 and the side 48 of the perimeter portion 41 define an opening through which the moulding 42 extends. The moulding 42 in this case has a rear inwardly extending lip 52 that is engageable with the terminal end of the flange 50 for retaining the moulding in a mounted position. A foam adhesive tape 54 is interposed between the forward side of the flange 50 and the rear face of the forward glass pane 31. It will be appreciated by one skilled in the art that the flange 50 also may serve as a screw top to prevent fastening screws utilized in securing corner key elements in the outer metal frame from engaging and possibly damaging the forward glass pane 31. Alternatively, as shown in FIG. 6, the side 48 of the frame perimeter portion 41 may be formed with a rear L-shaped leg 58 retained between the flange 56 and forward glass pane 31. An electrical heating wire 59 may be provided in the frame perimeter portion 41 in a passageway between the sides 45, 48, if necessary.

For retaining the glass unit 30 within the outer metal frame 40, the area between the spacers 35, the frame side wall 46, and the rear face of the forward glass pane 31 is filled with an adhesive 60, such as polysulfide. The ends of the glass panes protruding beyond the spacers 35 enhance securement of the glass unit by the adhesive 60. In the embodiment of FIG. 6, the adhesive extends into a channel 57 defined between the transverse wall 49 and the flange 56.

Figure 2:
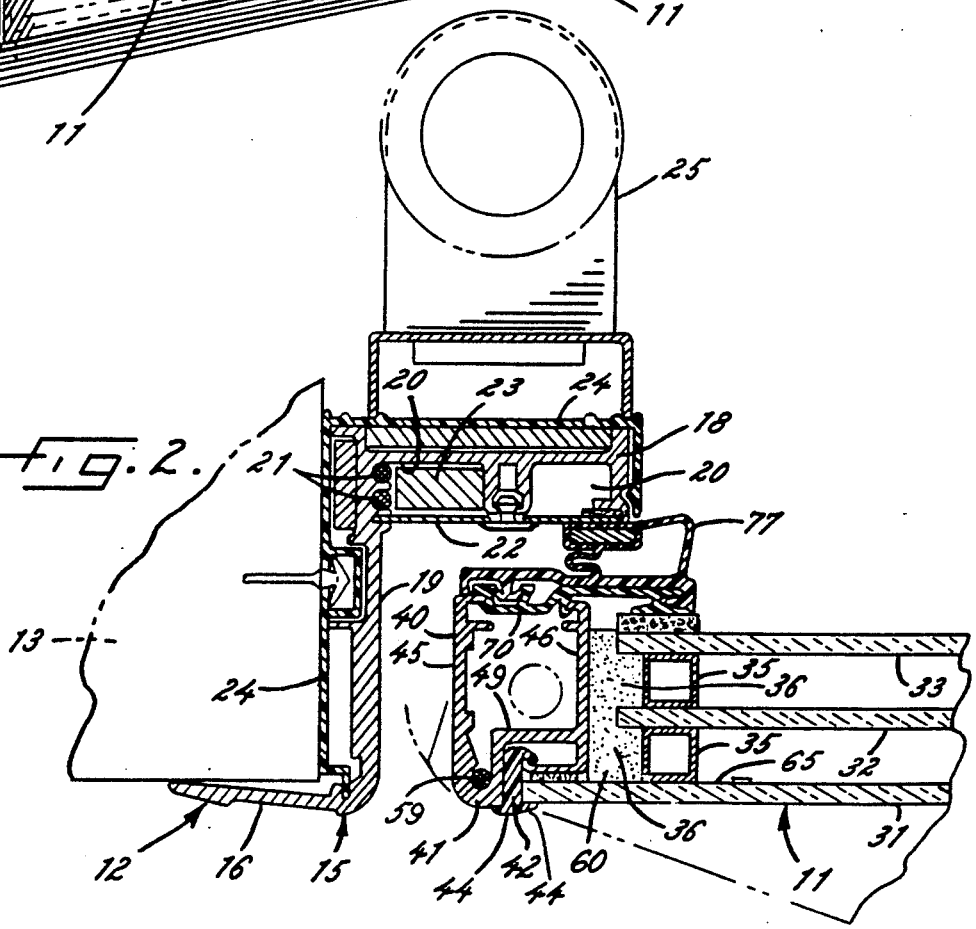
FIG. 2 is an enlarged fragmentary section taken in the plane of line 2—2 in FIG. 1.
Figure 3:
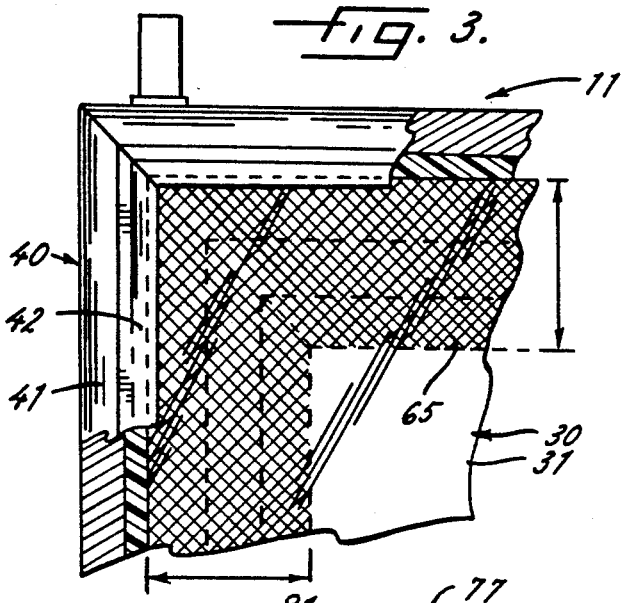
FIG. 3 is an enlarged partial plan view of a corner of one of the doors of the illustrated assembly with portions broken away.
Figure 4:
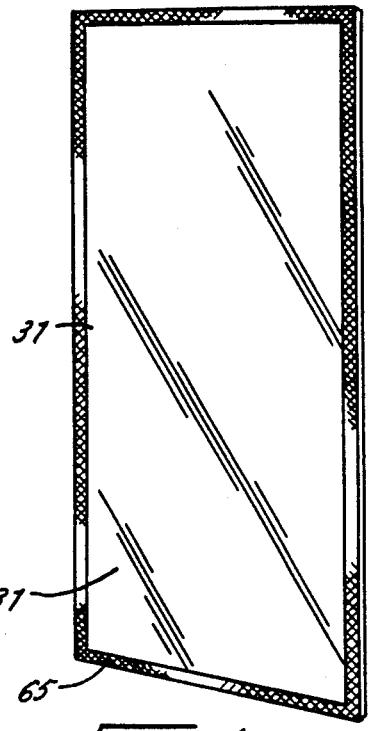
FIG. 4 is a perspective of a rear side of the forward glass pane of one of the doors.

In carrying out a further aspect of the invention, peripheral masking means is provided on the inner face of the forward glass pane for preventing viewing of the inner components of the door assembly through the forward glass pane from the front side thereof. In the illustrated embodiment, the masking is in the form of a dark silkscreen or ink 65 applied to the inner face of the forward glass pane 31 about its periphery, as shown in FIGS. 2 and 4. The masking 65 preferably extends from the peripheral edge of the glass pane 31 inwardly beyond the spacers 35 a distance so as to cover from view the inner portion of the frame 40 behind the glass pane 31, the adhesive tape 54, the polysulfide adhesive 60, the spacers 35, and the sealant between the spacers 35 and the forward glass pane 31. The dark colored silkscreen or ink 65 has been found to effectively mask such inner door assembly components, while at the same time enhancing the modernistic substantially all-glass front appearance for the door. A silkscreen bar 66 also may be applied to the inner face of the forward glass pane 31 to facilitate heating of the forward pane by conventional means if required.

For enclosing of a rear side of the metal frame 40 and covering the juncture between the rear side of the glass unit 30 and the outer metal frame 40, a back moulding 70, preferably made of aluminum, is adapted for snap action engagement between inwardly turned flanges 71, 72 of the outer frame side walls 45, 46. The back moulding 70 has an inwardly extending leg 74 secured to a rear face of the glass pane 33 by means of a double sides cellular foam tape 75.

For providing a seal between the door 11 and cabinet frame 12 when the door is in a closed position, a gasket sealing strip 76 is secured to the rear side of the moulding 70. The illustrated sealing strip 76, as best shown in FIG. 5, is formed with a T-shaped anchor 78 that is positively retained within inwardly extending retaining members 79 of the moulding 70, and the inner end of the sealing strip 76 has a U-shaped retaining flange 80 adapted for positive engagement with an inner end of the moulding 70. The sealing strip 76 has a gasket portion 77 which contains magnets 81 for creating a magnetic attraction with the cabinet frame cover plate 22, which may be made of stainless steel or other suitable magnetic material.

From the foregoing, it can be seen that the refrigerator door assembly of the present invention has a modernistic, substantially all-glass front appearance, but retains the efficiency and structural features of conventional insulated glass doors to which the industry has grown accustom over the years. Since the door assembly may be constructed in a manner substantially similar to that of conventional doors, it lends itself to economical manufacture by existing production techniques.

We claim:

1. A refrigerator door assembly comprising a cabinet frame for mounting in an opening of a refrigerator cabinet, an insulated glass door mounted for movement relative to said cabinet frame, said glass door comprising an insulated glass unit having a plurality of glass panes disposed in side-by-side relation and including a forward pane and a pane disposed rearwardly of said forward pane, a spacer interposed between at least some of said panes for maintaining said panes in parallel relation with an air space therebetween, an outer door support frame about the periphery of said glass unit for supporting the weight of said glass unit, said forward glass pane being larger in size than said rearwardly disposed pane and extending outwardly substantially to the outer perimeter of said door, said support frame having at least a portion being disposed rearwardly of said forward glass pane and being without any portion extending in overlapping relation to a front side of said forward glass pane, and masking means on said forward glass pane about the periphery thereof for preventing viewing of said spacer through said forward glass pane from a front side thereof while permitting unobstructed viewing of the interior of the refrigerator cabinet within which said door is mounted.

2. The refrigerator door assembly of claim 1 including sealant means associated with said glass panes and spacer for sealing said air space, and said masking means prevents viewing of said sealant means through said forward glass pane from a front side thereof.

3. The refrigerator door assembly of claim 1 including adhesive means between the said door support frame and an outer peripheral portion of said glass unit for securing said glass unit within said door support frame, and said masking means prevents viewing of said adhesive means through said forward glass pane from a front side thereof.

4. The refrigerator door assembly of claim 3 in which said adhesive is polysulfide.

5. The refrigerator door assembly of claim 1 including an intermediate pane disposed between said forward and rearwardly disposed panes, and said outer door support frame is disposed outwardly of the peripheral edges of said intermediate and rearwardly disposed panes.

6. The refrigerator door assembly of claim 1 in which said masking means is a silk screen coating affixed to an outer peripheral portion of said forward glass pane.

7. The refrigerator door assembly of claim 6 in which said silk screen is affixed to a rear face of said forward glass pane.

8. The refrigerator door assembly of claim 1 including a relatively narrow perimeter frame portion extending forwardly disposed in adjacent relation to an outer peripheral edge of said forward glass pane.

9. The refrigerator door assembly of claim 8 in which said narrow perimeter frame portion is an integral part of said door support frame.

10. The refrigerator door assembly of claim 8 including a molding interposed between said narrow perimeter frame portion and the outer peripheral edge of said forward pane.

11. The refrigerator door assembly of claim 10 in which said molding has a forward end extending over a front side of said narrow perimeter frame portion of said door frame and a front side of said forward glass pane.

12. The refrigerator door assembly of claim 8 in which said door support frame has a portion extending rearwardly to a location adjacent an outer peripheral edge of said rearwardly disposed pane.

13. The refrigerator door assembly of claim 1 in which said cabinet frame and door support frame are made of metal.

* * * * *